US010883397B2

(12) United States Patent
Burford

(10) Patent No.: US 10,883,397 B2
(45) Date of Patent: Jan. 5, 2021

(54) CENTRIFUGAL SEPARATOR ELECTRICALLY DRIVEN BY MAGNETISABLE REGIONS INTEGRATED INTO THE ROTARY VESSEL INTERACTING WITH ELECTROMAGNETIC WINDINGS IN THE HOUSING

(71) Applicant: MANN+HUMMEL GmbH, Ludwigsburg (DE)

(72) Inventor: Nigel Burford, Taunton (GB)

(73) Assignee: MANN+HUMMEL GmbH, Ludwigsburg (DE)

( * ) Notice: Subject to any disclaimer, the term of this patent is extended or adjusted under 35 U.S.C. 154(b) by 612 days.

(21) Appl. No.: 15/692,862

(22) Filed: Aug. 31, 2017

(65) Prior Publication Data

US 2018/0066550 A1 Mar. 8, 2018

(30) Foreign Application Priority Data

Sep. 2, 2016 (GB) ..... 1614964.3

(51) Int. Cl.

| | |
|---|---|
| ***F01M 1/10*** | (2006.01) |
| ***F02D 41/04*** | (2006.01) |
| ***B04B 7/08*** | (2006.01) |
| ***B04B 9/02*** | (2006.01) |
| ***B04B 9/10*** | (2006.01) |
| ***F01M 11/03*** | (2006.01) |

(52) U.S. Cl.

CPC ..... *F01M 1/10* (2013.01); *F02D 41/042* (2013.01); *B04B 7/08* (2013.01); *B04B 9/02* (2013.01); *B04B 9/10* (2013.01); *F01M 11/03* (2013.01); *F01M 2001/1035* (2013.01)

(58) Field of Classification Search

CPC .. F01M 1/10; F01M 11/03; F01M 2001/1035; F02D 41/042; B04B 7/08; B04B 9/02; B04B 9/10; B04B 9/00

USPC ..... 494/84

See application file for complete search history.

(56) References Cited

U.S. PATENT DOCUMENTS

| | | | | |
|---|---|---|---|---|
| 4,076,340 | A * | 2/1978 | Meinke | D01H 4/14 310/90.5 |
| 2008/0197793 | A1* | 8/2008 | Randall | H02P 25/092 318/254.1 |
| 2008/0315692 | A1* | 12/2008 | Beetz | B04B 9/04 310/52 |
| 2012/0308435 | A1* | 12/2012 | Fritchie | B04B 5/0421 422/73 |

(Continued)

FOREIGN PATENT DOCUMENTS

| | | | |
|---|---|---|---|
| DE | 2353342 | A1 | 5/1978 |
| JP | H08199646 | A | 8/1996 |
| WO | 9912651 | A1 | 3/1999 |

*Primary Examiner* — Walter D. Griffin
*Assistant Examiner* — Shuyi S. Liu
(74) *Attorney, Agent, or Firm* — James Hasselbeck

(57) ABSTRACT

A centrifugal separator includes a housing and a rotary vessel having an axis and being attached to the housing for rotation relative to the housing about the axis. Either: a) the rotary vessel has one or more magnetisable regions and the housing has one or more electromagnetic windings; or b) the rotary vessel has one or more electromagnetic windings and the housing has one or more magnetisable regions. The electromagnetic windings are selectively energisable to create a magnetic field to cause rotation of the rotary vessel.

16 Claims, 3 Drawing Sheets

(56) References Cited

U.S. PATENT DOCUMENTS

2015/0354475 A1* 12/2015 Ikemoto ..... F01P 7/14
123/41.02

* cited by examiner

CENTRIFUGAL SEPARATOR ELECTRICALLY DRIVEN BY MAGNETISABLE REGIONS INTEGRATED INTO THE ROTARY VESSEL INTERACTING WITH ELECTROMAGNETIC WINDINGS IN THE HOUSING

TECHNICAL FIELD

The invention relates to a centrifugal separator. The invention relates particularly, though not necessarily, to a centrifugal separator for removing contaminants from engine oil.

BACKGROUND

Centrifugal separators are well known for removing contaminant particles from a lubricating oil circuit of internal combustion engines. They are also known for separating particulate matter from liquids or separating liquids of different densities in a variety of industrial processes. Typically, the principle of operation of a centrifugal separator is that a housing contains a rotor which is supported therein to spin about a substantially vertical spindle. Liquid, e.g. engine oil, from which contaminants are to be removed, is supplied to the rotor at elevated pressure through a bore in the spindle. Outlet nozzles are provided at a radial distance from the spindle such that the pressurised fluid is ejected from the bore into the rotor in a direction generally tangential to the rotor, the tangential ejection of the fluid causing the rotor to spin. As the liquid passes through the spinning rotor, denser contaminants or particles are separated from the liquid centrifugally and retained in the rotor, typically as a cake adhering to the interior surface of the rotor. After circulation in the rotor, the liquid drains from the rotor to a sump.

The separation process is assisted by contaminant materials or particles agglomerating in the liquid. However, dispersant additives, which may be present in the liquid, may prevent agglomeration and reduce the effectiveness of the centrifugal separator. Also, the pressure at which the liquid is supplied to the rotor must be sufficient to cause the rotor to spin at a high enough speed to result in separation of the contaminant materials or particles centrifugally. It is an object of embodiments of the invention to at least mitigate one or more of the problems of the prior art.

SUMMARY OF THE INVENTION

According to an aspect of the invention, there is provided a centrifugal separator comprising: a housing; and a rotary vessel having an axis and being attached to the housing for rotation relative to the housing about the axis, characterised in that either: a) the rotary vessel has one or more magnetisable regions and the housing has one or more electromagnetic windings; or b) the rotary vessel has one or more electromagnetic windings and the housing has one or more magnetisable regions, and in that the electromagnetic windings are selectively energisable to create a magnetic field to cause rotation of the rotary vessel. This arrangement may allow for improved cleaning effectiveness of the centrifugal separator In certain embodiments, each of the one or more magnetisable regions may be one of one or more respective permanent magnets. Alternatively, each of the one or more magnetisable regions may be one of one or more respective electromagnetic coils.

Each of the one or more magnetisable regions may be attached to the rotary vessel or the housing. Each of the one or more magnetisable regions may be attached to an external surface of the rotary vessel or the housing. Each of the one or more magnetisable regions may be integral with the rotary vessel or the housing.

In certain embodiments, the one or more magnetisable regions may be circumferentially spaced about the rotary vessel or the housing. Pairs of the one or more magnetisable regions may be diametrically opposed about the axis.

Each of the one or more electromagnetic windings may be attached to the rotary vessel or the housing. Each of the one or more electromagnetic windings may be integral with the rotary vessel or the housing.

In certain embodiments, the one or more electromagnetic windings may be alternately selectively energisable. Each of the one or more electromagnetic windings may be electrically connectable to an electronic control unit ("ECU").

The centrifugal separator may further comprise the ECU to which each of the one or more electromagnetic windings is electrically connected. The ECU may have a plurality of output phases. Each of the output phases may correspond to each or groups of the one or more electromagnetic windings. The ECU may be configurable to alter the rotation speed of the rotary vessel.

In certain embodiments, each of the one or more electromagnetic windings is electrically connectable to an alternator.

According to a further aspect of the invention, there is provided a lubrication system for cleaning engine oil comprising a centrifugal separator as described above. According to another aspect of the invention, there is provided a vehicle comprising a centrifugal separator as described above. According to another aspect of the invention, there is provided a stationary engine arrangement comprising a centrifugal separator as described above.

BRIEF DESCRIPTION OF THE DRAWINGS

Embodiments of the invention will now be described, by way of example only, with reference to the accompanying figures, in which.

DETAILED DESCRIPTION

Figure 1:
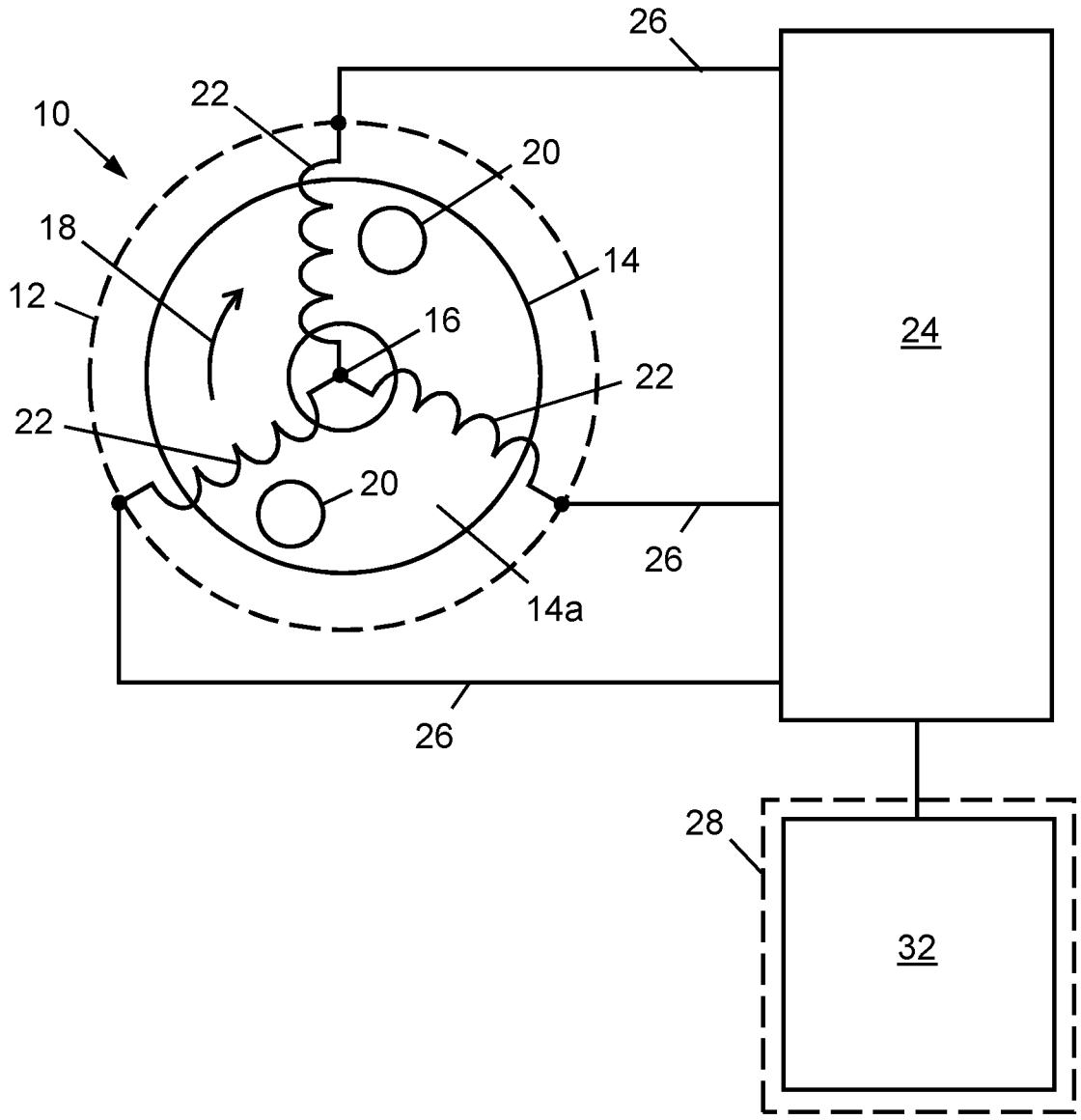
FIG. 1 shows a schematic of a centrifugal separator according to an embodiment of the invention.

FIG. 1 shows a centrifugal separator 10 according to an embodiment of the invention. The centrifugal separator 10 has particular application in a motor vehicle 336 (shown in FIG. 4) for cleaning engine oil in an engine lubrication system 234 (shown in FIG. 3). However, other applications are contemplated, e.g. oil recovery and the production of food products. The centrifugal separator 10 comprises a housing 12 and a rotary vessel 14 attached to the housing 12. The rotary vessel 14 has an axis 16 about which the rotary vessel 14 is configured to rotate, when the rotary vessel 14 is attached to the housing 12. Note that FIG. 1 shows the axis 16 extending into the page. In certain embodiments, the housing 12 may include a spindle (not shown) upon which the rotary vessel 14 is mounted for rotation. The spindle may include an axial bore for suppling the rotary vessel with a liquid to be cleaned. The housing 12 may have a generally annular profile for receiving the rotary vessel 14. In FIG. 1, an arrow 18 shows the direction of rotation of the rotary vessel 14. However, it will be understood that the rotary vessel 14 may rotate about the axis 16 in either direction, i.e. clockwise or anti-clockwise.

The rotary vessel 14 has one or more magnetisable regions 20, i.e. the regions 20 are capable providing a magnetic field. The magnetisable regions 20 may be formed of a magnetic material, i.e. a ferromagnetic or ferrimagnetic material. Specifically, the magnetic material may be, or at least include, one of iron, nickel and cobalt. In certain embodiments, the magnetic material may be any suitable magnetic material. Each of the one or more magnetisable regions 20 may be attached to, or integral with, the rotary vessel 14. Moreover, each of the one or more magnetisable regions 20 may be attached to a surface 14*a* of the rotary vessel 14. The surface 14*a* may be an exterior surface of the rotary vessel 14. The surface 14*a* may be one or more of a top surface of the rotary vessel 14, a bottom surface of the rotary vessel 14 and a side surface of the rotary vessel 14. In embodiments where the magnetisable regions 20 are attached to the rotary vessel 14, the means of attachment of the magnetisable regions 20 maybe chemical or mechanical, e.g. a glue, a bonding agent, a clip or a screw. The magnetic material may be magnetised, i.e. each of the one or more magnetisable regions 20 may be provided as one of one or more permanent magnets. In alternative embodiments, each of the one or more regions magnetisable 20 may be one of one or more electromagnetic coils, e.g. coils of insulted copper or aluminium wire. Each of the electromagnet coils may have a respective magnetic core, i.e. a core made of, or at least including, a magnetic material, e.g. iron, nickel or cobalt. Any suitable number of the magnetisable regions 20 may be provided. FIG. 1 shows the centrifugal separator 10 having two of the magnetisable regions 20. However, in certain embodiments, the rotary vessel 14 may alternatively have one, three, four or more of the magnetisable regions 20. The magnetisable regions 20 may be circumferentially spaced about the rotary vessel 14. Additionally, pairs of the magnetisable regions 20 may be diametrically opposed about the axis 16, as illustrated in FIG. 1.

The housing 12 has one or more electromagnetic windings 22, i.e. one or more electrical conductors, e.g. copper or aluminium wire, in the shape of a coil, a spiral or a helix. Each of the one or more windings 22 may be have a respective magnetic core, i.e. a core made of, or at least including, a magnetic material, e.g. iron, nickel or cobalt. The electromagnetic windings may be circumferentially spaced about the housing 12. Each of the one or more electromagnetic windings 22 may be attached to, or integral with, the housing 14. The electromagnetic windings 22 are selectively energisable to create a magnetic field. The electromagnetic windings 22 may be selectively energisable by supplying an electric current thereto. In certain embodiments, the electric current may be selectively supplied to an individual, or groups, of the one or more of the electromagnetic windings 22 in sequence, i.e. the electromagnetic windings 22 are alternately selectively energisable, to produce a magnetic field, the position of which rotates around the housing 12. While the centrifugal separator 10 shown in FIG. 1 has three electromagnetic windings 22, it will be understood that any suitable number of electromagnetic windings 22 may be used, e.g. one, two, four or more electromagnetic windings 22. Two or more of the electromagnetic windings 22 may be electrically connected in series.

In embodiments where the magnetic material is magnetised, the rotary vessel 14 may permanently exhibit a magnetic field. In embodiments where the regions 20 of the magnetic material are respective electromagnetic coils, as the magnetic field rotates about the housing 12 or pulses, a current may be induced in the rotary vessel 14. (More specifically, a current may be induced in the electromagnetic coils). Thus, the rotary vessel 14 may produce a magnetic field, which opposes the magnetic field of the housing 12, as according to Lenz's law. In all embodiments, the interaction between the magnetic field of the housing 12 and the magnetic field of the rotary vessel 14 will cause the rotary vessel 14 to spin about the axis 16, i.e. a reaction torque is applied to the rotary vessel 14.

In use, a liquid, from which contaminants are to be removed, is supplied to the rotary vessel 14, e.g. through the axial bore. As the rotary vessel 14 spins about the axis 16, denser contaminant particles are separated from the liquid centrifugally and are retained in the rotary vessel 14. After circulation in the rotary vessel 14, the liquid, having been cleansed, exits the rotary vessel 14 via drains. The rotation speed of the rotary vessel 14 during separation of the denser contaminant particles from the liquid may be between 3,000 and 30,000 revolutions per minute. In certain embodiments, the rotation speed of the rotary vessel 14 during separation of the denser contaminant particles from the liquid may be between 3,000 and 10,000 revolutions per minute. In certain embodiments, the rotation speed of the rotary vessel 14 during separation of the denser contaminant particles from the liquid may be between 10,000 and 30,000 revolutions per minute. In certain embodiments, the rotation speed of the rotary vessel 14 during separation of the denser contaminant particles from the liquid may be between 10,000 and 20,000 revolutions per minute.

In certain embodiments, each of the electromagnetic windings 22 may be electrically connectable to an electrical control unit ("ECU") 24 via respective electrical connections 26. Thus, when the ECU 24 and electromagnetic windings 22 are electrically connected to one another, the ECU 24 may supply the electrical current to the electromagnetic windings 22 required to create the magnetic field. The ECU 24 may have a plurality of output phases, allowing the ECU 24 to supply the electrical current to an individual, or groups, of the one or more electromagnetic windings 22 in sequence. Each, or groups, of the electromagnetic windings 22 may correspond to an output phase of the ECU 24. Thus, as in the illustrated embodiment, the ECU 24 may have three output phases. Of course, in alternative embodiments, the ECU may have any suitable number of output phases, e.g. one, two or more output phases. Each output phase may correspond to two or more of the electromagnetic windings 22. FIG. 1 schematically shows the electromagnetic windings 22 and the electrical connections 26 in a star configuration for three output phases of the ECU 24. However, it will be understood that other configurations are possible, e.g. a delta configuration. The exact configuration of the one or more electromagnetic windings 22 and the respective one or more electrical connections will depend on the number thereof.

In certain embodiments, the ECU 24 may be connected to an alternator 28 for use in the vehicle 336. More specifically, the ECU 24 may be electrically connected to a rectifier 32 of the alternator 28 to provide, in use, the ECU with a source of electrical power. Of course, the ECU 24 may be additionally or alternatively connected to any suitable other source of electrical power, e.g. a battery. The ECU 24 may be configurable to vary the rotation speed of rotary vessel 24.

Figure 2:
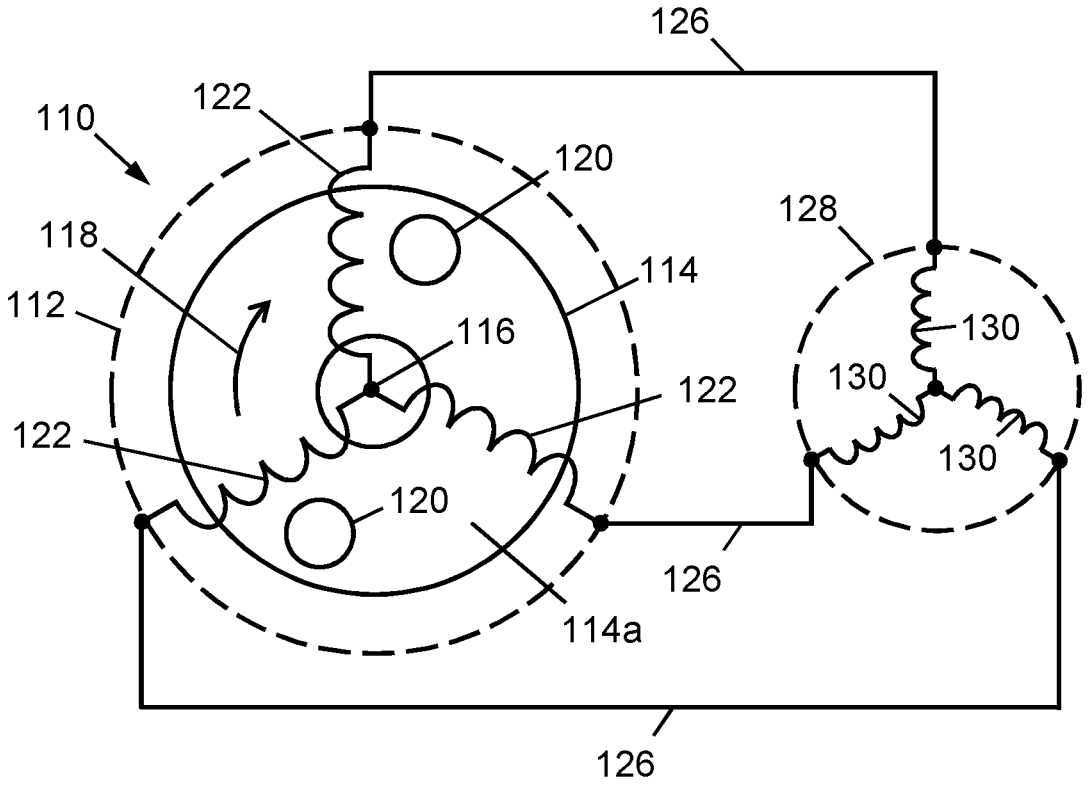
FIG. 2 shows a schematic of a centrifugal separator according to a further embodiment of the invention.

FIG. 2 shows a centrifugal separator 110 according to a further embodiment of the invention, with reference numerals offset by a factor of 100 identifying like features discussed herein with reference to FIG. 1. Each of the one or more electromagnetic windings 122 may be electrically connectable to an alternator for the vehicle. More specifically, each of the electromagnetic windings 122 may be electrically connectable to one of one or more respective windings 130 of the alternator 128. (The windings 130 of the alternator 128 will be understood to be electromagnetic windings in which an electric current may be induced by a spinning rotor of the alternator 128, but will be referred to in this specification, including the claims, as windings, to avoid confusion with the electromagnetic windings 122 of the centrifugal separator 110.) Consequently, when the electromagnetic windings 122 and the windings 130 of the alternator 128 are electrically connected to one another, an electric current in the windings 130 of the alternator 128, e.g. that which is created when the alternator 128 is in operation, may supply the electric current to the electromagnetic windings 122 required to create a magnetic field. Thus, in use, embodiments having the electromagnetic windings 122 electrically connected to the windings 130 of the alternator 128, the rotary vessel 114 may rotate at substantially the same rotation speed as the alternator 128.

Figure 3:
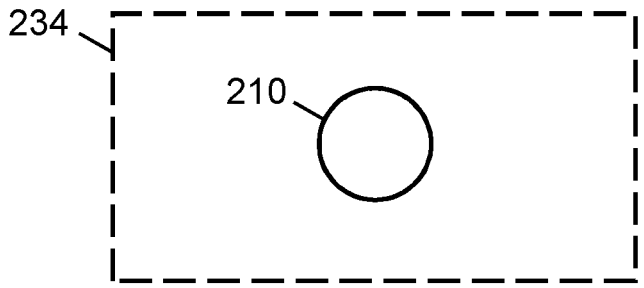
FIG. 3 shows a schematic of lubrication system comprising a centrifugal separator according to an embodiment of the invention.
Figure 4:
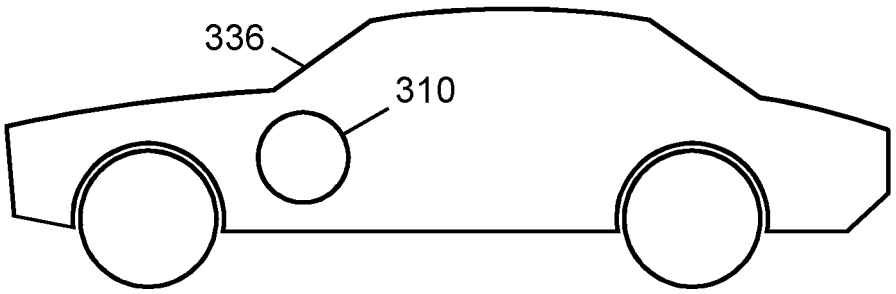
FIG. 4 shows a schematic of vehicle comprising a centrifugal separator according to an embodiment of the invention.

FIG. 3 shows a lubrication system 234 comprising a centrifugal separator 210. FIG. 4 shows a vehicle 336 comprising a centrifugal separator 310. The vehicle 336 may be one of a motorcar, a motorbike, an aircraft and a marine vessel. The vehicle 336 may be one of a truck, a bus or a train.

As will be understood from the above, in all embodiments the housing 12 forms a stator and the rotary vessel 14 forms a rotor, thus together the housing 12 and the rotary vessel 14 form a motor. The housing 12 and the rotary vessel 14 may together form a permanent magnet AC motor (which is also referred to as an AC brushless motor). Of course, alternative embodiments are contemplated, e.g. the housing 12 and the rotary vessel 14 together forming a DC brushless motor, as any suitable means of forming the housing 12 as a stator and the rotary vessel 14 as a rotor may be used. Thus, embodiments are contemplated in which the rotary vessel 14 has one or more electromagnetic windings 22 and the housing 12 has one or more magnetisable regions 20.

Embodiments of the invention may allow for improved cleaning effectiveness of the centrifugal separator 10, when compared to known devices, as the rotation speed of the rotary vessel 14 may be independent of the pressure of the fluid to be cleaned supplied thereto. Embodiments of the invention may allow the use of high dispersant additives in liquids to be cleaned while maintaining sufficient cleaning effectiveness. Embodiments of the invention may allow the centrifugal separator 10 to continue to operate after engine shut down to prevent captured contaminant material accumulating in, or blocking, the drains of the rotary vessel 14. Embodiments of the invention may allow for "soft" start and stops of the centrifugal separator 10, i.e. a gradual increase and decreased of rotation speed between the rotary vessel 14 being stationary and the rotating speed for separation.

All of the features disclosed in this specification (including any accompanying claims and drawings) may be combined in any combination, except combinations where at least some of such features and/or steps are mutually exclusive.

Each feature disclosed in this specification (including any accompanying claims and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims and drawings). The claims should not be construed to cover merely the foregoing embodiments, but also any embodiments which fall within the scope of the claims.

What is claimed is:

1. A centrifugal separator comprising:

a housing; and a rotary vessel having an axis of rotation, the rotary vessel contained within the housing and rotatably attached to the housing for rotation relative to the housing about the axis, the rotary vessel receiving liquids from which contaminants are to be removed, denser contaminants or particles are separated from the liquid centrifugally in the rotary vessel and retained within the rotary vessel as a cake adhering to an interior surface of the rotary vessel, wherein the rotary vessel has a plurality of magnetisable regions circumferentially spaced apart on an exterior surface of the rotary vessel and the housing has one or more electromagnetic windings, and in that the one or more electromagnetic windings are selectively energisable to create a magnetic field to cause rotation of the rotary vessel, wherein each of the plurality of magnetisable regions are integral fixed to the exterior surface of the rotary vessel.

2. The centrifugal separator according to claim 1, wherein each of the a plurality of magnetisable regions is one of one or more respective permanent magnets; or each of the a plurality of magnetisable regions is one of one or more respective electromagnetic coils.

3. The centrifugal separator according to claim 1, wherein the each of the a plurality of magnetisable regions is integral to an external surface of the rotary vessel.

4. The centrifugal separator according to claim 1, wherein pairs of the a plurality of magnetisable regions are diametrically opposed about the axis.

5. The centrifugal separator according to claim 1, wherein each of the one or more electromagnetic windings is attached to the housing.

6. The centrifugal separator according to claim 1, wherein each of the one or more electromagnetic windings is integral with the housing.

7. The centrifugal separator according to claim 1, wherein each of the one or more electromagnetic windings is electrically connected to an electronic control unit ("ECU") or an alternator, wherein the one or more electromagnetic windings are alternately selectively energized by the electronic control unit ("ECU") or the alternator.

8. The centrifugal separator according to claim 1, further comprising an electronic control unit ("ECU") to which each of the one or more electromagnetic windings is electrically connected, the ECU configured to control a rotation speed of the rotary vessel by alternately and selectively energizing the one or more electromagnetic windings.

9. The centrifugal separator according to claim 8, wherein the ECU has a plurality of output phases.

10. The centrifugal separator according to claim 9, wherein each of the plurality of output phases corresponds to each or groups of the one or more electromagnetic windings.

11. The centrifugal separator according to claim 8, wherein the ECU is configurable to alter the rotation speed of the rotary vessel.

12. The centrifugal separator according to claim 1, wherein each of the one or more electromagnetic windings is electrically connected to windings of an alternator, the alternator establishing a rotation speed of the rotary vessel by alternately and selectively energizing the one or more electromagnetic windings, such that the rotation speed of the rotary vessel substantially matches a rotation speed as the alternator.

13. A lubrication system for cleaning engine oil comprising a centrifugal separator according to claim 1.

14. A vehicle or a stationary engine comprising a centrifugal separator according to claim 1.

15. The centrifugal separator according to claim 2, wherein pairs of the plurality of magnetisable regions are diametrically opposed about the axis of rotation, wherein the one or more electromagnetic windings is a plurality of electromagnetic windings, wherein each of the plurality of electromagnetic windings is attached to the housing, wherein the plurality of electromagnetic windings are alternately selectively energisable, the centrifugal separator further comprising an electronic control unit ("ECU") to which each of the plurality of electromagnetic windings is electrically connected, the ECU configured to control a rotation speed of the rotary vessel by alternately and selectively energizing at least a respective one of the plurality of electromagnetic windings, wherein the ECU is adapted to and configurable to alter the rotation speed of the rotary vessel.

16. The centrifugal separator according to claim 15, wherein wherein the ECU has a plurality of output phases, wherein each of the plurality of output phases is connected to each or groups of the one or more electromagnetic windings.

* * * * *